US010973303B2

(12) United States Patent
Esposito

(10) Patent No.: US 10,973,303 B2
(45) Date of Patent: Apr. 13, 2021

(54) BLOTTING AND LIPSTICK SYSTEM

(71) Applicant: Barbara Esposito, Boynton Beach, FL (US)

(72) Inventor: Barbara Esposito, Boynton Beach, FL (US)

( * ) Notice: Subject to any disclaimer, the term of this patent is extended or adjusted under 35 U.S.C. 154(b) by 0 days.

(21) Appl. No.: 15/949,068

(22) Filed: Apr. 9, 2018

(65) Prior Publication Data

US 2019/0307230 A1 Oct. 10, 2019

(51) Int. Cl.

| | |
|---|---|
| ***B43K 27/02*** | (2006.01) |
| ***A45D 40/24*** | (2006.01) |
| ***A45D 40/06*** | (2006.01) |
| ***A45D 40/18*** | (2006.01) |
| *A45D 40/00* | (2006.01) |

(52) U.S. Cl.

CPC ..... *A45D 40/24* (2013.01); *A45D 40/06* (2013.01); *A45D 40/18* (2013.01); *A45D 2040/0006* (2013.01); *A45D 2040/0025* (2013.01); *A45D 2200/1045* (2013.01); *A45D 2200/1063* (2013.01)

(58) Field of Classification Search

CPC ..... A45D 44/12; A45D 40/18; A45D 40/24; A45D 2200/1063

USPC ..... 401/19

See application file for complete search history.

(56) References Cited

U.S. PATENT DOCUMENTS

| | | | | |
|---|---|---|---|---|
| 2,573,828 | A * | 11/1951 | Braselton | A45D 40/04 401/31 |
| 6,345,922 | B2 * | 2/2002 | Tani | A45D 40/04 401/116 |
| 6,371,675 | B1 * | 4/2002 | Hoang | A45D 34/04 401/135 |
| 6,896,433 | B1 * | 5/2005 | Zhang | A45D 34/042 401/17 |
| 8,961,053 | B1 * | 2/2015 | Esposito | A45D 40/26 401/11 |
| 10,051,942 | B2 * | 8/2018 | Golding | A45D 40/24 |
| 10,154,720 | B2 * | 12/2018 | Yeung | A45D 40/04 |
| 2016/0120290 | A1 * | 5/2016 | Chen | A45D 40/18 132/314 |

* cited by examiner

*Primary Examiner* — Jennifer C Chiang

(57) ABSTRACT

A blotting and lipstick system in a single component wherein one end comprises a lipstick and the other end comprises a blotter. The blotting and lipstick system in one device provides a convenient way for a user to apply a beautifying cosmetic to the lips and then blot the lipstick to prevent the lipstick from getting on the teeth of the user. Both the lipstick and the blotter have a rotating mechanism whereby they can be raised or lowered for convenience.

10 Claims, 3 Drawing Sheets

BLOTTING AND LIPSTICK SYSTEM

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of cosmetics and more specifically relates to a blotting and lipstick system.

2. Description of the Related Art

Lipstick is a commonly used cosmetic that is believed to enhance the appearance of the wearer; however, a side effect is that lipstick tends to get into the user's teeth unknowingly. Sometimes after the application of lipstick, the user may blot their lips by using a tissue or napkin to make sure no lipstick will get into the user's teeth. Facial tissues and other commonly used blotting materials have the disadvantages of being generally too large for convenience, of being so flimsy as to require both hands of the user to properly position it for use and of such thin and absorbent material as to leave bits of tissue on the lips.

The present invention features a blotting and lipstick system whereby a blotting apparatus and lipstick apparatus are together in one apparatus for the user's convenience. There are two ends to the system. One end of the system contains a lipstick apparatus. The other end of the system contains a durable and convenient blotting apparatus.

Various attempts have been made to solve the above-mentioned problems such as those found in U.S. Pat. Nos. 5,285,799; 6,013,34; D354,374. This art is representative of lipstick blotting apparatus. None of the above inventions and patents, taken either singly or in combination, is seen to describe the invention as claimed.

Ideally, a blotting and lipstick system should provide a user with a system to apply lipstick and then blot the lips to prevent lipstick from getting on the teeth with one hand and, yet would operate reliably and be manufactured at a modest expense. Thus, a need exists for a reliable blotting and lipstick system in one convenient apparatus to avoid the above-mentioned problems.

BRIEF SUMMARY OF THE INVENTION

In view of the foregoing disadvantages inherent in the known cosmetic art, the present invention provides a novel system for applying then blotting lipstick. The general purpose of the present invention, which will be described subsequently in greater detail is to provide a single convenient apparatus wherein one end allows a user to apply lipstick and the other end provides a user with a blotter.

The present invention holds significant improvements and serves as a novel blotting and lipstick system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a blotting and lipstick system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a beauty enhancing cosmetic system and more particularly to a blotting and lipstick system as used to improve the user with a way to conveniently apply lipstick and then blot said lipstick to avoid getting lipstick on the teeth of the user.

Figure 1:
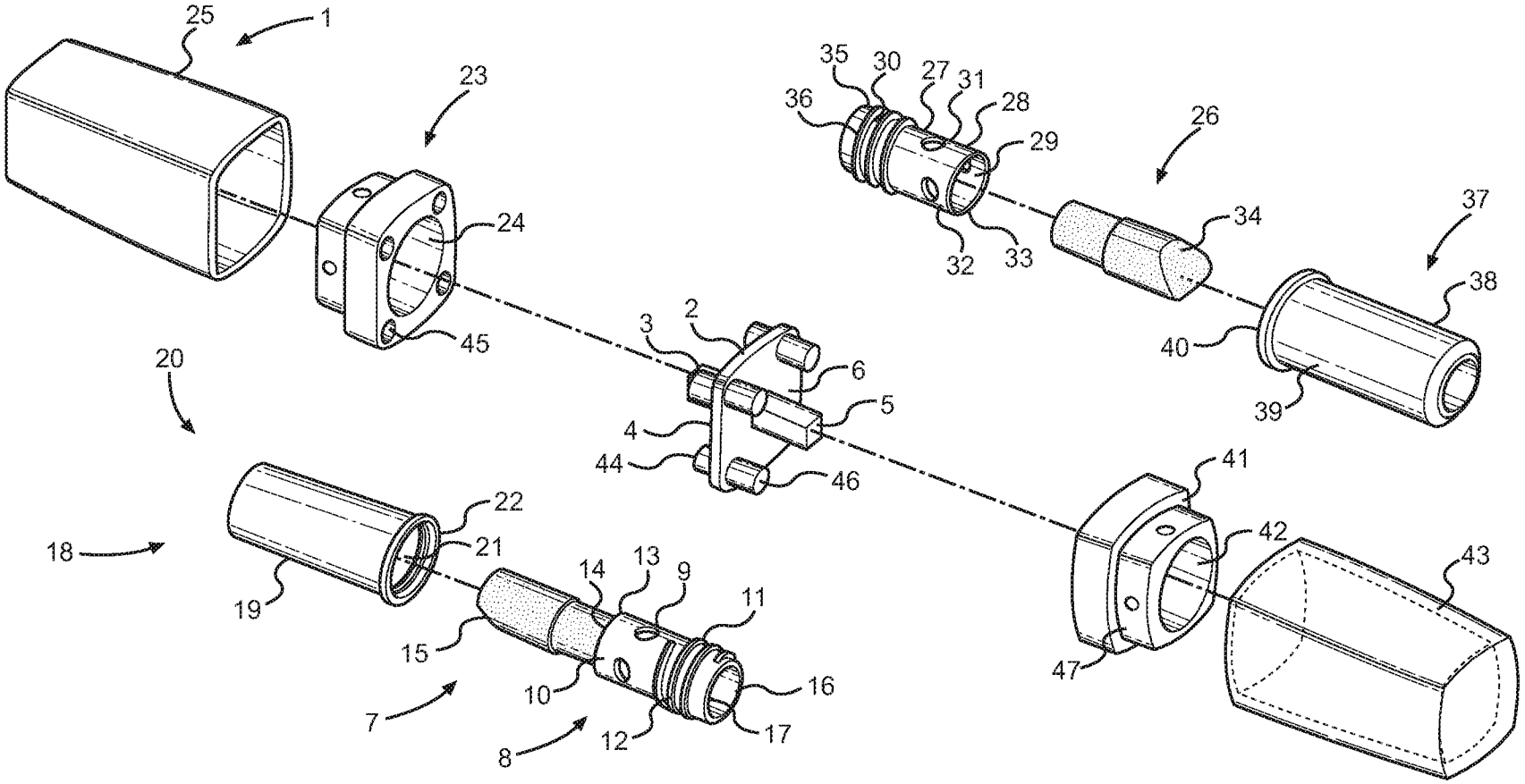
FIG. 1 shows a perspective view illustrating an exploded view of a blotting and lipstick system according to an embodiment of the present invention.
Figure 2:
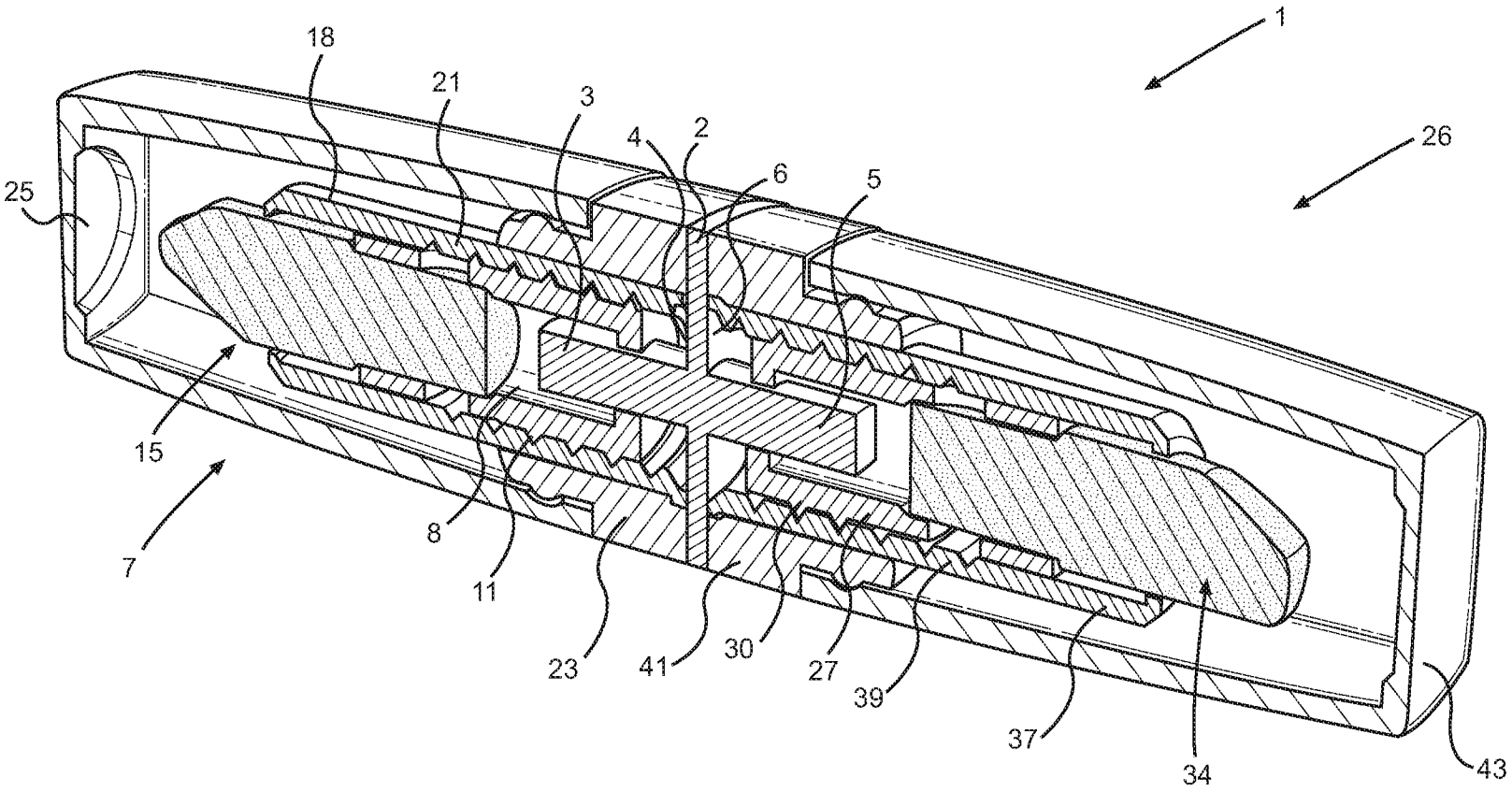
FIG. 2 is a perspective view illustrating a cross sectional view of a blotting and lipstick system according to an embodiment of the present invention of FIG. 1.
Figure 3:
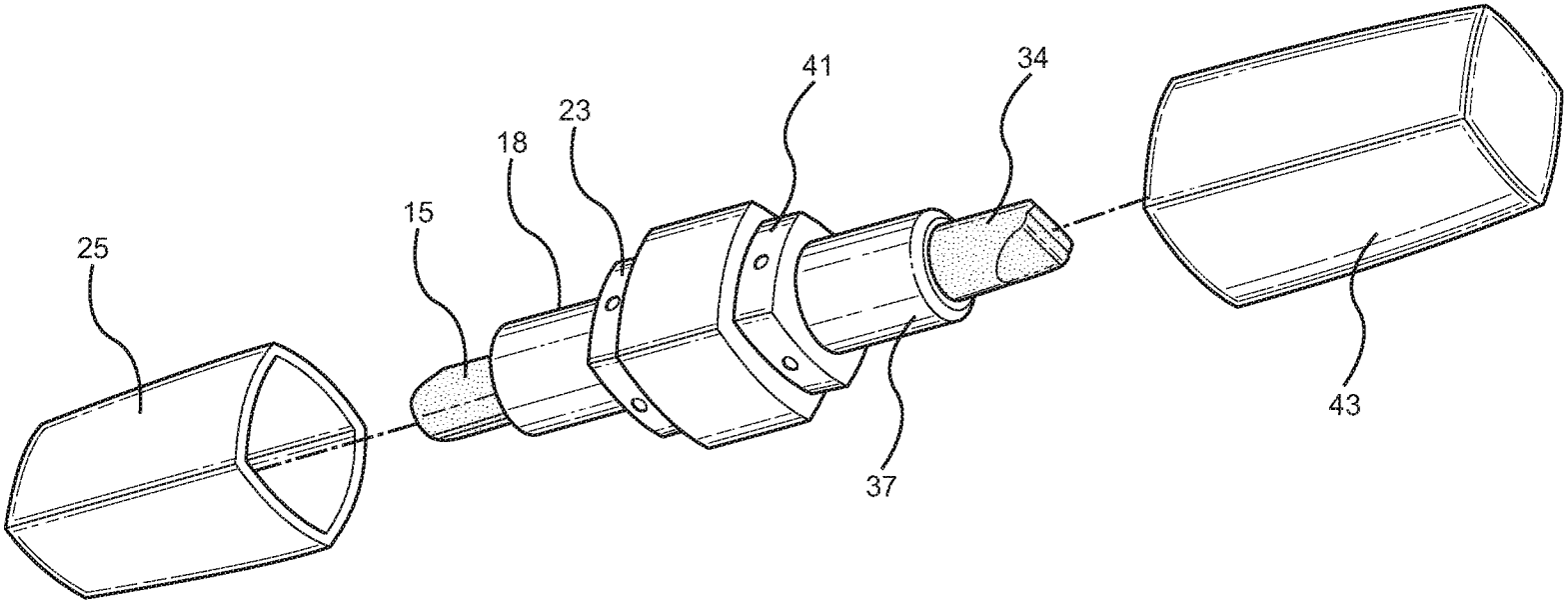
FIG. 3 is a perspective view illustrating a perspective view of a blotting and lipstick system according to an embodiment of the present invention of FIG. 1.

Referring to the drawings by numerals of reference there is shown in FIGS. 1-3, the blotting and lipstick system 1 according to an embodiment of the present invention and includes a center plate 2 having a blotter post 3. The blotter post 3 extends perpendicularly from a first side 4 of the center plate 2 and is formed having a rectangular cross-section.

The blotting and lipstick system 1 further includes a lipstick post 5 which extends perpendicularly from a second side 6 the center plate 2 and is also formed having a rectangular cross-section. The blotting and lipstick system 1 further includes a blotting apparatus 7 comprising a base member 8 including a cylindrical body 9 forming a hollow interior 10. A plurality of threads 11 extend from an exterior surface 12 of the base member 8.

The base member 8 of the blotting apparatus 7 also includes a blotter end 13 having an opening 14 for receiving a blotter member 15 therein. The base member 8 also has a connector end 16 having a rectangular aperture 17 therethrough adapted to receive and slide linearly upon the blotter post 3.

The blotting apparatus 7 also includes a rotator member 18 which includes a cylindrical body 19 forming a hollow interior 20 and having a plurality of threads 21 on its interior surface 22. The threads 21 of the cylindrical body 19 are adapted to interdigitate and rotatably interact with the plurality of threads 11 of the base member 8 such that when the rotator member 18 of the blotting apparatus 7 is rotated, the base member 8 can move linearly in and out with respect to the center plate 2.

The blotting apparatus 7 also includes a connector member 23 which has a cylindrical aperture 24 therethrough adapted to slidably receive the rotator member 18. The connector member 23 is adapted to connect with the first side 4 of the center plate 2 and movably retain the rotator member 18 therebetween.

The blotter member 15 is located within the interior of the base member 8 and is adapted to extend outwardly therefrom. A cap member 25 is adapted to releasably engage the connector member 23 of the blotting apparatus 7 by either friction fit or conventional detent means to cover the rotator member 18 and the blotter member 15.

The blotting and lipstick system 1 further includes a lipstick apparatus 26 comprising a base member 27 including a cylindrical body 28 having a hollow interior 29 and a plurality of exterior threads 30 located on an outer surface 31 of the cylindrical body 28. The base member 27 of the lipstick apparatus 26 further includes a lipstick receiving end 32 having an opening 33 for receiving a lipstick member 34 therein.

The base member 27 of the lipstick apparatus 26 further comprises a connector end 35 having a rectangular aperture 36 therethrough adapted to receive and slide linearly upon the lipstick post 5 of the center plate 2. The lipstick apparatus 26 further includes a rotator member 37 having a cylindrical body 38 forming a hollow interior and having a plurality of threads 39 located on its interior surface 40. The plurality of interior threads 39 are adapted to interdigitate and rotatably interact with the plurality of exterior threads 30 of the base member 27 and moves linearly therein in and out.

The lipstick apparatus 26 further comprises a connector member 41 including a cylindrical aperture 42 therethrough adapted to slidably receive the rotator member 37 therethrough. Furthermore, the connector member 41 is adapted to connect with the second side 6 of the center plate 2 and movably retain the rotator member 37 therebetween.

The lipstick member 34 for applying tint to a user's lips is located within the interior 29 of the base member 27 and is adapted to extend outwardly therefrom. A cap member 43 is adapted to releasably engage the connector member 41 by a friction fit or a conventional detent and to removably cover the rotator member 37 and lipstick member 34.

The center plate 2 includes at least two spaced connector posts 44 extending from the first side 4. The connector member 23 of the blotting apparatus 7 includes at least two connector holes 45 therein which are adapted to engage the connector posts 44 to hold the connector member 23 of the blotting apparatus in place. Likewise, the center plate 2 also includes at least two spaced connector posts 46 extending from the second side 6 thereof adapted to engage connector holes 47 in the connector member 41 of the lipstick apparatus in place.

The cap member 25 of the blotting apparatus 7 and the cap member 43 of the lipstick apparatus 26 are formed of a plastic material. The blotter member 15 can be formed from a foamed material, a polyether material or a polyurethane material. The base members 8 and 27 respectively and the rotator members 18 and 37 respectively are formed from a list of materials consisting of plastic, metal and ceramic.

The connector members 23 and 41 respectively and the center plate 2 are formed having a substantially rectangular cross section. The base members 8 and 27 respectively as well as the rotator members 18 and 37 respectively are all formed having a circular cross section.

Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application

What is claimed is:

1. A blotting and lipstick system including:

a center plate including:

a blotter post;

wherein said blotter post extends perpendicularly from a first side thereof and is formed having a rectangular cross-section; and a lipstick post;

wherein said lipstick post extends perpendicularly from a second side thereof and is formed having a rectangular cross-section; and a blotting apparatus comprising:

a base member including:

a cylindrical body forming a hollow interior;

a plurality of threads located on an exterior surface thereof;

a blotter receiving end having an opening for receiving a blotter member therein;

a connector end having a rectangular aperture therethrough adapted to receive and slide linearly upon said blotter post;

a rotator member including;

a cylindrical body forming a hollow interior;

a plurality of threads located on an interior surface thereof adapted to interdigitate and rotatably interact with said plurality of threads of said base member, such that when said rotator member is rotated said base member moves linearly therein;

a connector member including;

a cylindrical aperture therethrough adapted to slidably receive said rotator member therethrough; and wherein said connector member is adapted to connect with said first side of said center plate and movably retain said rotator member therebetween;

a blotter member;

wherein said blotter member is located within said interior of said base member and adapted to extend outwardly therefrom, and adapted to retain a solution therein for application to a person's lips when in use; and a cap member;

wherein said cap member is adapted to releasably engage said connector member and removably cover said rotator member and said blotter member; and a lipstick apparatus comprising:

a base member including:

a cylindrical body forming a hollow interior;

a plurality of threads located on an exterior surface thereof;

a lipstick receiving end having an opening for receiving lipstick member therein;

a connector end having a rectangular aperture therethrough adapted to receive and slide linearly upon said lipstick post;

a rotator member including;

a cylindrical body forming a hollow interior;

a plurality of threads located on an interior surface thereof adapted to interdigitate and rotatably interact with said plurality of threads of said base member, such that when said rotator member is rotated said base member moves linearly therein;

a connector member including;

a cylindrical aperture therethrough adapted to slidably receive said rotator member therethrough; and wherein said connector member is adapted to connect with said second side of said center plate and movably retain said rotator member therebetween;

a lipstick member;

wherein said lipstick member is located within said interior of said base member and adapted to extend outwardly therefrom, and adapted to apply lipstick to a person's lips when in use; and a cap member;

wherein said cap member is adapted to releasably engage said connector member and removably cover said rotator member and said blotter member.

2. The blotting and lipstick system of claim 1, wherein said center plate includes at least two spaced connector posts extending from said first side thereof; wherein said connector member of said blotting apparatus includes at least two connector holes therein adapted to engage respective said at least two spaced connector posts of said first side of said center plate such that said connector member is held in place thereon; wherein said center plate includes at least two spaced connector posts extending from said second side thereof; and wherein said connector member of said lipstick apparatus includes at least two connector holes therein adapted to engage respective said at least two spaced connector posts of said second side of said center plate such that said connector member is held in place thereon.

3. The blotting and lipstick system of claim 1, wherein said cap member of said blotting apparatus and said cap member of said lipstick apparatus are formed from a plastic material.

4. The blotting and lipstick system of claim 1, wherein said blotter member is formed from a foamed material.

5. The blotting and lipstick system of claim 1, wherein said blotter member is formed from a polyether material.

6. The blotting and lipstick system of claim 1, wherein said blotter member is formed from a polyurethane material.

7. The blotting and lipstick system of claim 1, wherein said base member and said rotator member of said blotting apparatus and said base member and said rotator member of said lipstick apparatus are formed from a material chosen from a list of materials consisting of plastic, metal, and ceramic.

8. The blotting and lipstick system of claim 1, wherein said connector member of said blotting apparatus, said connector member of said lipstick apparatus, and said center plate are formed having a substantially rectangular cross section.

9. The blotting and lipstick system of claim 1, wherein said base member and said rotator member of said blotting apparatus are formed having a circular cross section; and wherein said base member and said rotator member of said lipstick apparatus are formed having a circular cross section.

10. The blotting and lipstick system of claim 8, wherein said base member and said rotator member of said blotting apparatus are formed having a circular cross section; and wherein said base member and said rotator member of said lipstick apparatus are formed having a circular cross section.

* * * * *